US005177312A

United States Patent [19]

Kozuki

[11] Patent Number: 5,177,312

[45] Date of Patent: Jan. 5, 1993

[54] ELECTRONIC MUSICAL INSTRUMENT HAVING AUTOMATIC ORNAMENTAL EFFECT

[75] Inventor: Koichi Kozuki, Hamamatsu, Japan

[73] Assignee: Yamaha Corporation, Hamamatsu, Japan

[21] Appl. No.: 776,872

[22] Filed: Oct. 16, 1991

Related U.S. Application Data

[63] Continuation of Ser. No. 370,326, Jun. 22, 1989, abandoned.

[30] Foreign Application Priority Data

Jun. 22, 1988 [JP] Japan ..... 63-154059
Nov. 16, 1988 [JP] Japan ..... 63-289871

[51] Int. Cl.[5] ..... G10H 1/26; G10H 1/28

[52] U.S. Cl. ..... 84/610; 84/638; 84/634

[58] Field of Search ..... 84/609, 610, 613, 614, 84/634, 637, 638, 649, 666, 669, 712, 715, 716, DIG. 22

[56] References Cited

U.S. PATENT DOCUMENTS 4,166,405 9/1979 Hiyoshi et al. ..... 84/1.24
4,267,762 5/1981 Aoki et al. ..... 84/638 X
4,387,618 6/1983 Simmons, Jr. ..... 84/DIG. 22 X
4,429,606 2/1984 Aoki ..... 84/DIG. 22 X
4,489,636 12/1984 Aoki et al. ..... 84/DIG. 22 X
4,508,002 2/1985 Hall et al. ..... 84/DIG. 22 X
4,519,286 5/1985 Hall et al. ..... 84/DIG. 22 X
4,624,170 11/1986 Ohno et al. ..... 84/638 X

FOREIGN PATENT DOCUMENTS 56-39595 4/1981 Japan .
60-12639 4/1985 Japan .

*Primary Examiner*—W. B. Perkey
*Attorney, Agent, or Firm*—Graham & James

[57] ABSTRACT

An electronic musical instrument generates musical tones corresponding to a melody tone and a chord tone which are designated by a performer. In order to apply a specific musical effect or generate an ornament, a front percussive tone, or forefall, is automatically added to the melody tone, wherein this front percussive tone has the predetermined pitch difference with respect to the melody tone. This front percussive tone is additionally generated prior to the melody tone in the predetermined short period. Instead of this front percussive tone, it is possible to generate an additional tone which has the same tone name as any one of constituent tones within the chord tone but its tone pitch is different from that of the melody tone. When generating plural melody tones and plural additional tones, these tones are sequentially generated by a predetermined time difference in a pitch descending or ascending order.

7 Claims, 11 Drawing Sheets

81: FRONT PERCUSSIVE TONE TABLE

| ADDRESS | TBLONM | | TBLDWN | RT = C | |
|---|---|---|---|---|---|
| | TP UPPER 4 BITS | DLT LOWER 4 BITS | | ♪ | ♩ |
| 0 | 0 | 4 | 2 | D | E |
| 1 | 1 | 4 | 1 | D# | E |
| 2 | 1 | 11 | 2 | A | B |
| 3 | 2 | 4 | 2 | D | E |
| 4 | 3 | 3 | 1 | D | D# |
| 5 | 4 | 3 | 1 | D | D# |
| 6 | 4 | (11) | 1 | A# | B |
| 7 | 5 | 3 | 1 | D | D# |
| 8 | 5 | 6 | 1 | F | F# |
| 9 | 6 | 4 | 2 | D | E |
| 10 | 6 | 10 | 1 | A | A# |
| 11 | 7 | 3 | 1 | D | D# |
| 12 | 7 | 8 | 1 | G | G# |
| 13 | 7 | 10 | 1 | A | A# |
| 14 | 8 | 3 | 1 | D | D# |
| 15 | 8 | 6 | 1 | F | F# |
| 16 | 8 | 10 | 1 | A | A# |
| 17 | 9 | 4 | 2 | D | E |
| 18 | 10 | (2) | 2 | C | D |
| 19 | 10 | 4 | 2 | D | C |
| 20 | 10 | 8 | 2 | F# | G# |
| 21 | 11 | 3 | 1 | D | D# |
| 22 | 11 | (6) | 1 | F | F# |
| 23 | 11 | (9) | 1 | G# | A |

FIG. 2A

82: ARPEGGIO TONE TABLE

| TYPE TP | TBLARP (TP, i) | | | |
|---|---|---|---|---|
| | i = 0 | i = 1 | i = 2 | i = 3 |
| 0 | 4 | 0 | 7 | - |
| 1 | 11 | 4 | 0 | 7 |
| 2 | 9 | 4 | 0 | 7 |
| 3 | 3 | 0 | 7 | - |
| 4 | 10 | 3 | 0 | 7 |
| 5 | 9 | 3 | 0 | 7 |
| 6 | 10 | 4 | 0 | 7 |
| 7 | 10 | 5 | 0 | 7 |
| 8 | 10 | 6 | 3 | 0 |
| 9 | 10 | 6 | 4 | 0 |
| 10 | 8 | 4 | 0 | - |
| 11 | 9 | 6 | 3 | 0 |

FIG. 2B

ELECTRONIC MUSICAL INSTRUMENT HAVING AUTOMATIC ORNAMENTAL EFFECT

This is a continuation of application Ser. No. 07/370,326 filed on Jun. 22, 1989, now abandoned.

BACKGROUND OF THE INVENTION

1. Field of the Invention

The present invention relates to an electronic musical instrument, and more particularly to an electronic musical instrument capable of generating a melody tone and its ornament (or decorative tone) together.

2. Prior Art

Conventionally, the electronic musical instrument as disclosed in Japanese Patent Publication No. 60-12639 additionally generates a front percussive tone prior to a musical tone of a depressed key, wherein this front percussive tone, or forefall, concerns the depressed key. More specifically, an increment value ΔKC indicative of the predetermined pitch difference (such as a semitone, 3rd degree, 5th degree etc.) is added to a key code KC indicative of the depressed key in the predetermined short period from the key-depression event. Thus, for this predetermined short period, this electronic musical instrument generates a musical tone having a tone pitch corresponding to the added key code KC+ΔKC. Thereafter, the tone pitch of the generated musical tone is varied to that corresponding to the original key code KC.

However, in this electronic musical instrument, the above front percussive tone must be added to all musical tones of the keys to be depressed. For this reason, it is disadvantageous in that the generated musical tones must sound heavy and the music performed by the keyboard must be heard lengthy and irksome as a whole.

Another electronic musical instrument as disclosed in Japanese Patent Publication No. 56-39595 can perform the music heavy and with variety. More specifically, just after this electronic musical instrument generates a melody tone designated by a melody keyboard, it sequentially generates each of the musical tones with a short time difference such as 30 milli-seconds (ms) to 100 ms, wherein each of these musical tones has the same tone name of each of constituent tones of a chord designated by an accompaniment keyboard but its tone pitch is set above the certain tone pitch which is one octave below the melody tone.

However, the last of the musical tones which are sequentially generated in response to the key-depressions of the melody keyboard will not relate to the melody tone which is designated by the melody keyboard. In short, this last musical tone will not relate to the main melody line. Therefore, it is disadvantageous in that the main melody line must be inarticulate.

SUMMARY OF THE INVENTION

The present invention provides an electronic musical instrument capable of automatically and additionally generating a front percussive tone, or forefall, prior to the melody tone. This allows a specific musical effect, such as a musical effect for country music, to be automatically obtained.

The present invention further provides an electronic musical instrument capable of sequentially generating a melody tone and an additional tone, wherein this additional tone has the same tone name as any one of the constituent tones within the chord, but its tone pitch is set equal to that of the constituent tone or within the pitch range of one or two octaves departing from the tone pitch of the constituent tone.

In a first preferred embodiment, the present invention provides an electronic musical instrument employing a melody designating circuit for designating a tone pitch of a melody to be generated, a chord designating circuit for designating a chord tone to be generated, and a judging circuit for judging whether or not there is a predetermined relationship satisfied between the melody tone and the chord tone. The electronic musical instrument further employs circuitry for adding a front percussive tone, or forefall, to the melody tone when the judging circuit judges that there is a predetermined relationship between the melody tone and the chord tone. The front percussive tone has a predetermined pitch difference with respect to the melody tone, and is generated prior to the melody tone for a predetermined short period. When the judging circuit judges that the predetermined relationship between the melody tone and the chord tone is not satisfied, the front percussive tone is not added to the melody tone. The electronic musical instrument further includes a musical tone signal generator for generating a musical tone signal based on the chord tone and the melody tone added with the percussive tone.

In a second preferred embodiment, the present invention provides an electronic musical instrument employing a melody designating circuit for designating a first melody tone to be generated, a chord designating circuit for designating a chord tone to be generated, a musical tone signal generator for generating a musical tone signal, and a circuit for deciding whether or not an additional tone is to be additionally generated. Preferably, the additional tone has the same tone name as any one of constituent tones within the chord tone, and a tone pitch equal to that between the first melody tone and a second melody tone which has a pitch difference of one or more octaves with respect to the first melody tone. The electronic musical instrument also employs a control circuit for generating a musical tone generation control signal by which the musical tone signal generator is controlled such that musical tone signals corresponding to the first melody tone, the second melody tone and the additional tone are sequentially generated by a predetermined time difference in a predetermined pitch order.

In a third preferred embodiment, the present invention provides an electronic musical instrument employing a melody designating circuit, a chord designating circuit, and a musical tone signal generator for generating a musical tone signal. A first selecting circuit is provided for selecting plural additional tones to be additionally generated, wherein each of the additional tones has the same tone name as any one of constituent tones within the chord tone and a tone pitch equal to that between the first melody tone and a second melody tone which has a pitch difference of one or more octaves with respect to the first melody tone. The electronic musical instrument further includes circuitry for excluding certain additional tones from the plural additional tones, wherein each of the certain additional tones to be excluded has a tone pitch which is relatively close to that of the first melody tone or the second melody tone, and a second circuit for selecting a certain number of additional tones from the additional tones which are selected by the first selecting circuit but not excluded by the excluding circuit. Preferably, the certain number of additional tones are decided by a priority order corresponding to the chord tone to be designated. Control circuitry for generating a musical tone generation control signal is also provided, by which the musical tone signal generator is controlled such that musical tone signals corresponding to the first melody tone, the second melody tone and the certain number of additional tones are sequentially generated by a predetermined time difference in a pitch descending order.

In a fourth preferred embodiment, the present invention provides an electronic musical instrument employing a melody keyboard which is performed by a performer so that a desirable tone pitch of a melody tone to be sounded is designated, an accompaniment keyboard which is performed by a performer so that a desirable chord tone to be sounded is designated, and an operator controlled designation mechanism for allowing designation of at least a tone color and a tone volume of a musical tone to be sounded. A memory is employed for storing data concerning additional tones to be sounded with the melody tone. The electronic musical instrument further provides a musical tone signal generator for generating a musical tone signal and control circuitry for controlling the musical tone signal generator. The control circuitry automatically and arbitrarily selects one or more additional tones from the memory. Under the control of the control circuitry and the operator controlled designation mechanism, the musical tone signal generator generates musical tone signals based on the chord tone, the melody tone and the additional tone so that desirable musical tones may be sounded.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings:

FIGS. 2A and 2B are drawings respectively showing data formats of a front percussive tone table and a arpeggio tone table shown in FIG. 1;

DESCRIPTION OF A PREFERRED EMBODIMENT

[A] Configuration of an Embodiment

Figure 1:
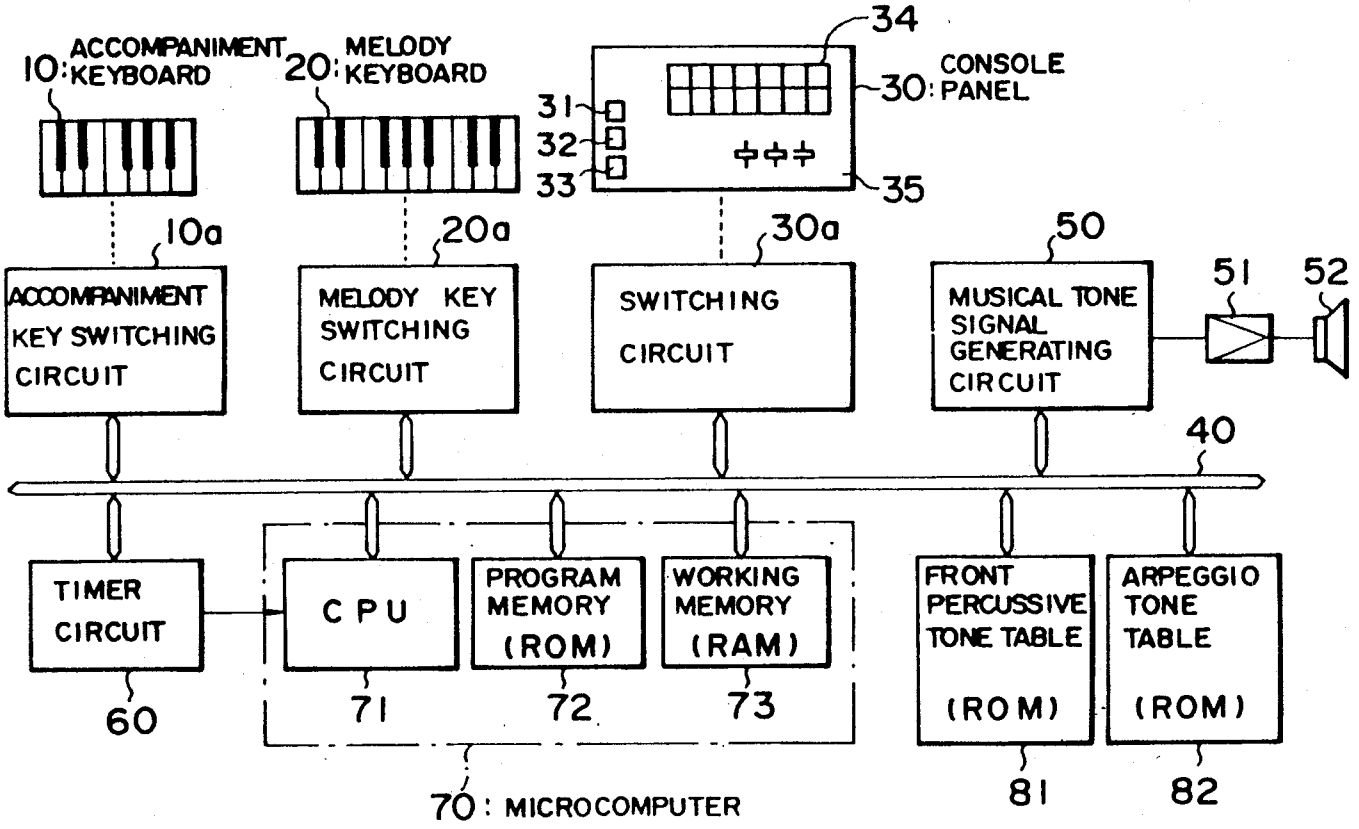
FIG. 1 is a block diagram showing the whole configuration of the electronic musical instrument according to an embodiment of the present invention.

Referring now to the drawings, wherein like reference characters designate like or corresponding parts throughout the several views, FIG. 1 is a block diagram showing the whole configuration of the electronic musical instrument according to an embodiment of the present invention.

This electronic musical instrument a shown in FIG. 1 provides an accompaniment keyboard 10, a melody keyboard 20 and a console panel 30. The accompaniment keyboard 10 including plural keys is provided for the chord performance, wherein the key-depression or key-release of each key is detected by corresponding one of plural key switches in an accompaniment key switching circuit 10*a*. Similarly, the melody keyboard 20 including plural keys is provided for the melody performance, wherein the key-depression and key-release of each key is detected by corresponding one of plural key switches in a melody key switching circuit 20*a*.

The console panel 30 provides first to third mode switches 31, 32 and 33 for designating first to third modes respectively; tone color switches 34 for designating the tone color; and tone volume controls 35 for designating the desirable tone volume. The operations of these switches 31 to 35 are detected by a switching circuit 30*a*.

In the present embodiment, the following three modes are set.

(1) First Mode

This first mode corresponds to the so-called normal mode, wherein the electronic musical instrument generates the musical tone having the tone pitch which is designated by the depressed key in the melody keyboard 20.

(2) Second Mode

Figure 10A:
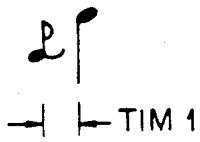
FIGS. 10A and 10B show notes for explaining tone-generation states of the front percussive tone and arpeggio tone.

This second mode is provided for the country music, wherein a front percussive tone, or forefall is additionally generated prior to the musical tone whose tone pitch is designated by the depressed key in the melody keyboard 20 (see FIG. 10A). This ornamental effect is also sometimes referred to by the Italian expression "appoggiatura" or the German expression "vorschlag" or "vorschulag".

(3) Third Mode

This third mode is provided for the cocktail music played by piano, for example. This music is played by piano in the cocktail bar, for example. In the third mode, the electronic musical instrument generates a first musical tone whose tone pitch is designated by the depressed key of the melody keyboard 20, and it also generates other second to fourth musical tones. The second musical tone has the tone pitch which is one octave below the tone pitch of the first musical tone. The third and fourth musical tones are two constituent tones within the chord tone designated by the accompaniment keyboard 10, the tone pitches of these third and fourth musical tones are set within the pitch range between the tone pitches of first and second musical tones. These first to fourth musical tones are sequentially generated, wherein one musical tone is generated prior to another musical tone with the predetermined time difference (see FIG. 10B).

Next, the accompaniment key switching circuit 10*a*, melody key switching circuit 20*a* and switching circuit 30*a* are connected to a bus 40.

This bus 40 is further connected to a musical tone signal generating circuit 50, a timer circuit 60 and a microcomputer 70. This musical tone signal generating circuit 50 provides eight channels in order to independently generate the musical tones corresponding to the plural musical instruments such as piano, violin and the like, for example. Each channel outputs each musical tone corresponding to several data which is supplied to the musical tone signal generating circuit 50 from the microcomputer 70 via the bus 40. In these eight channels, No. 0 to No. 3 channels are used for forming the melody tone signal including a front percussive tone signal and an arpeggio tone signal, while No. 4 to No. 7 channels are used for forming the chord tone signal. In the foregoing first to third modes, all of No. 0 to No. 3 channels are used. However, in the second mode, No. 0 channel is only used. The musical tone signal generating circuit 50 is connected to a speaker 52 via an amplifier 51.

The timer circuit 60 internally provides an oscillator having the fixed frequency, so that it outputs a timer interrupt signal to the microcomputer 70 by every period corresponding to its fixed frequency.

The microcomputer 70 includes a central processing unit (CPU) 71, a program memory 72 and a working memory 73, all of which are connected to the bus 40. The CPU 71 starts to execute a main program (see FIG. 3) when a power switch (not shown) is on. Then, this main program is repeatedly executed until the power switch is off. Every time the timer circuit 60 supplies the timer interrupt signal to the CPU 71, the CPU 71 breaks its execution and then executes a timer interrupt program (see FIG. 7). The program memory 72 is constructed by a read-only memory (ROM), which stores several kinds of programs corresponding to the flowcharts shown in FIGS. 3 to 9. The working memory 73 is constructed by a random-access memory (RAM), which temporarily stores several kinds of data and flags which are necessary to execute the above programs. Herein, description with respect to these data and flags will be given later in the description of programs.

Moreover, the bus 40 is connected to a front percussive tone table 81 and an arpeggio tone table 82, both of which are constructed by the ROM. As shown in FIG. 2A, the front percussive tone table 81 has twenty-four addresses consisting of No. 0 to No. 23 addresses, wherein front percussive tone data TBLONM and down data TBLDWN are stored in each address. The front percussive tone data TBLONM consists of eight bits, wherein the upper four bits (i.e., the leftmost nybble or most significant nybble) indicates type data TYPE indicative of the chord type detected by the electronic musical instrument and the lower four bits (i.e., the rightmost nybble or least significant nybble) indicate interval data DLT. This interval data DLT indicates the interval of certain musical tone by every semitone, wherein this certain musical tone is to be added with the front percussive tone in response to the detected chord type and this interval is defined as the upper interval from the root tone within the whole interval of certain musical tone. On the other hand, the down data TBLDWN indicates lower interval by every semitone. In the rightmost column of "RT=C" of FIG. 2A wherein the root tone is set as the "C" tone, the left-row-characters indicate the tone pitches of front percussive tones and the right-row-characters indicate the tone pitches of melody tones to which the front percussive tones are to be added. In the right row "DLT" in column "TBLONM" of FIG. 2A, the number in parentheses such as (11) designates the front percussive tone whose tone-generation is depending on the performer.

As shown in FIG. 2B, the arpeggio tone table 82 stores the foregoing type data TYPE and the arpeggio tone data TBLARP(TP,i) indicative of the constituent tones within the chord tone which are generated as the arpeggio tones. In this case, each data TBLARP(TP,i) indicates the upper interval by every semitone, wherein the variable i=0 to 3 corresponds to the priority order for the arpeggio tones to be additionally generated. In FIG. 2B, "—" means that there is no arpeggio ton to be added.

Now, before describing the operations of the present embodiment which is configured as described heretofore, description will be given with respect to the key code KC and the chord type to be detected, wherein the tone pitch of the musical tone to be generated by the electronic musical instrument is designated by this key code KC. In the present embodiment, the tone pitch of the generated musical tone changes within the range of key areas C1 to C7. Herein, each of the key areas C1 to C6 includes twelve keys, but the key area C7 includes only one key, so that the total number of the keys within the all key areas is "73". In this case, the key code KC of the first key in the key area C1 has value "24", and this value is incremented by "1" by every key. So, the value of key code KC changes from "24" to "96" within the key areas C1 to C7.

The following Table shows the chord types to be detected and code values of the type data TYPE.

TABLE

| Chord Type Name | Code |
|---|---|
| Major M | 0 |
| Major Seven $M_7$ | 1 |
| Sixth $6_{th}$ | 2 |
| Minor m | 3 |
| Minor Seven $m_7$ | 4 |
| Minor Sixth $m_6$ | 5 |
| Sevens $7_{th}$ | 6 |
| Seven Suspended Four $7_{SUS4}$ | 7 |
| Minor Sevens Flat Five $m7^{-5}$ | 8 |
| Sevens Flat Five $7^{-5}$ | 9 |
| Augment aug | 10 |
| Diminish dim | 11 |

[B] Operation of Embodiment

Next, description will be given with respect to the operations of the present embodiment by referring to the flowcharts as shown in FIGS. 3 to 9.

Figure 3:
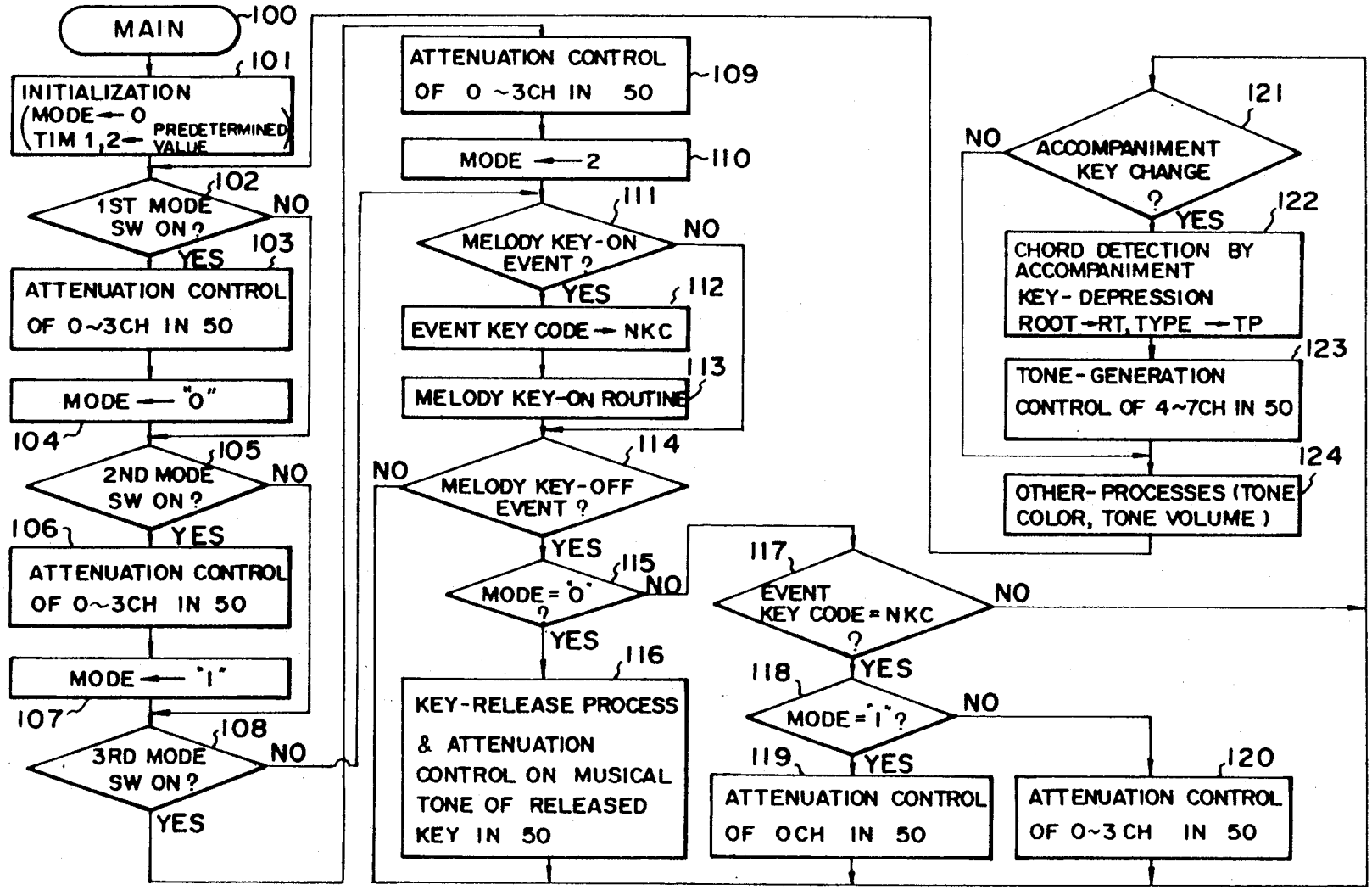
FIGS. 3-5, 6A, 6B, and 7-9 are flowcharts indicating programs which are executed by a microcomputer shown in FIG. 1.

By operating the power switch on, the CPU 71 starts to execute the main program from step 100 shown in FIG. 3. In first step 101, mode data MODE is initialized to "0", and each of first and second time data TIM1, TIM2 is initialized to its predetermined initial value. This mode data MODE designates any one of the foregoing first to third modes. In the present embodiment, the first mode is set when MODE is at "0"; the second mode is set when MODE is at "1"; and third mode is set when MODE is at "2". The first time data TIM1 indicates the tone-generation period of the front percussive tone which is generated in the second mode, while the second time data TIM2 indicates the tone-generation delay time for the arpeggio tones, wherein TIM1, TIM2 indicate these times in relation to the timer interrupt signal from the timer circuit 60. Each time is set around 30 ms to 100 ms.

After the above-mentioned initialization, the CPU 71 will execute the circulating processes of steps 102 to 124, by which the tone-generations of the melody tone, chord tone, front percussive tone, arpeggio tone and the like are controlled in response to the operations of mode switches 31 to 33, melody keyboard 20, accompaniment keyboard 10, tone color switches 34 and tone volume controls 35.

In these circulating processes, when the first mode switch 31 is operated, the judgment result of step 102 turns to "YES" so that the musical tone signals generated from No. 0 to No. 3 channels in the musical tone signal generating circuit 50 are attenuated in step 103. Then, the mode data MODE is set at "0" in step 104. These processes of steps 102 to 104 are not required when the first mode is set in step 101. However, when the second or third mode is set in next processes of steps 105 to 110, these processes of steps 102 to 104 are required. By the process of step 103, the channels which are provided for generating the melody tone, front percussive tone and arpeggio tone are prepared for generating the musical tones in the new mode, and the first mode is set. In the meantime, when the first mode switch 31 is not operated, the judgement result of step 102 turns to "NO" so that the processing of CPU 71 proceeds to step 105.

When the second mode switch 32 or third mode switch 33 is operated, the judgment result of step 105 or 108 turns to "YES" so that the process identical to that of the foregoing step 103 is executed in step 106 or 109. Thus, No. 0 to No. 3 channels are prepared for newly generating the musical tones. Then, MODE is set at "1" in step 107 so that the second mode is set, or MODE is set at "2" in step 110 so that the third mode is set. If the mode switches 32, 33 are not operated, the judgement results of steps 105, 108 turn to "NO" respectively. In this case, the processings proceed to steps 108, 111 respectively.

Meanwhile, when the key is depressed in the melody keyboard 20, the key-depression event (or key-on event) is detected in step 111 so that the processing proceeds to steps 112 and 113. When the depressed key is released in the melody keyboard 20, the key-release event (or key-off event) is detected in step 114 so that the processing proceeds to steps 115 to 120. By the processes of these steps 112, 113 and 115 to 120, the tone-generations of the melody tone, front percussive tone and arpeggio tone are controlled. In the present specification, the detailed description will be given later with respect to these processes.

On the other hand, when the key in the accompaniment keyboard 10 is depressed or released, the variation of accompaniment key is detected in step 121 whose judgement result will turn to "YES". Thus, the processing proceeds to step 122 wherein the chord tone to be designated by the performer is detected based on key information concerning the depressing key in the accompaniment keyboard 10. Then, the data indicative of the chord type of the detected chord tone is set and stored as type data TP, wherein the value of this data is any one of "0" to "11" described in the foregoing Table. In addition the data indicative of the root tone of the detected chord tone is set and stored as root tone data RT, wherein value "0" of this data corresponds to the C tone and value "11" of this data corresponds to the B tone. In next step 123, plural key codes KC and channel data are supplied to the musical tone signal generating circuit 50, wherein each channel data indicates the channels (i.e., No. 4 to No. 7 channels) to which each key code KC is assigned. As a result, the musical tone signal generating circuit 50 forms the musical tones having the tone pitches corresponding to the key codes KC at its No. 4 to No. 7 channels. Then, the mixed musical tone signals are supplied to the speaker 52 via the amplifier 51. Thus, the speaker 52 generates the musical tones corresponding to the chord tone designated by the accompaniment keyboard 10. Incidentally, if any variation is detected in the operating state of the accompaniment key, the judgement result of step 121 turns to "NO" so that the processing proceeds to step 124.

When the tone color switches 34 or tone volume controls 35 are operated, the operation thereof is detected so that the data concerning the switches 34 or controls 35 are supplied to the musical tone signal generating circuit 50 in step 124. This data controls the tone color and/or tone volume of the musical tone signal formed in the circuit 50.

Next, detailed description will be given with respect to the tone-generation controls of the melody tone, front percussive tone and arpeggio tone. In the present embodiment, such controls are different in each mode, therefore, this description will be given by each mode.

(1) FIRST MODE

As described before, this first mode is set in step 101 or steps 102 to 104, wherein the mode data MODE is set at "0".

In the case where the main program as shown in FIG. 3 is circulatedly executed, when any key of the melody keyboard 20 is depressed, the key-depression event is detected in the melody keyboard 20 so that the judgement result of step 111 turns to "YES". Thus, the event key code indicative of the depressed melody key is set and stored as a ne key code NKC in step 112. Then, in step 113, the CPU 71 executes processes of a melody key-on routine.

Figure 4:
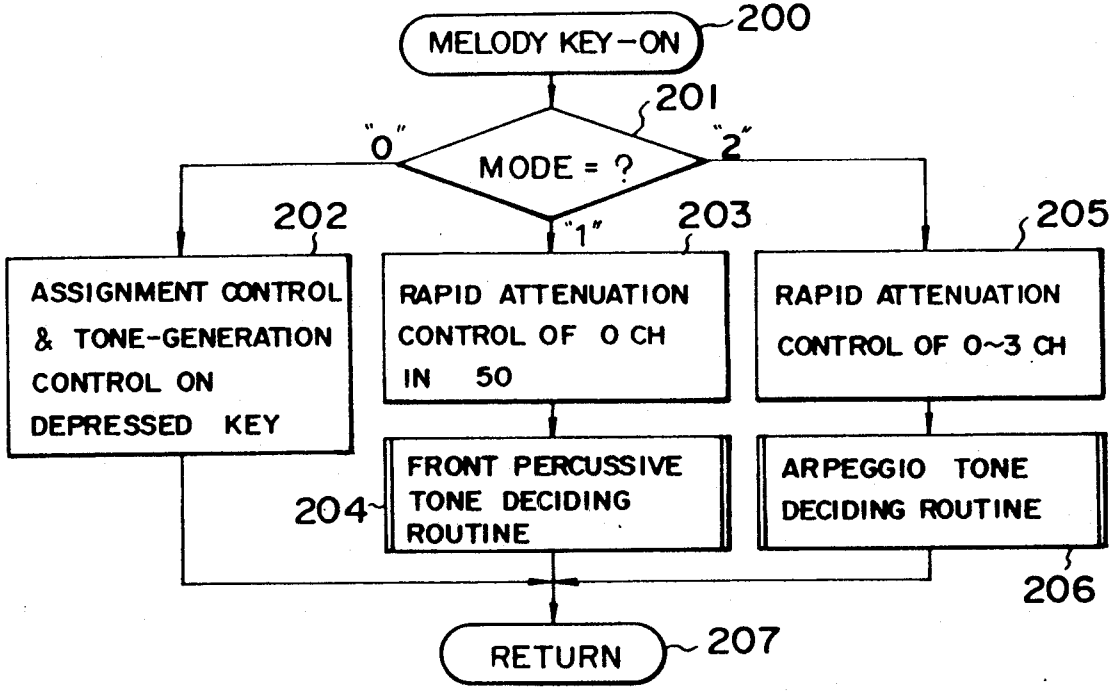

This melody key-on routine as shown in FIG. 4 is started from step 200, and then the value of mode data MODE is detected in step 201. In the first mode, the mode data MODE is at "0", so that the processing proceeds to step 202. In this step 202, the new key code NKC is assigned to any one of No. 0 to No. 3 channels, in other words, the CPU 71 executes the channel assignment control on the newly depressed key. Then, the new key code NKC and the channel data indicative of the assigned channel are supplied to the musical tone signal generating circuit 50, wherein the musical tone signal (i.e., melody tone signal) having the tone pitch corresponding to the new key code NKC is generated and outputted from the assigned channel. This melody tone signal is supplied to the speaker 52 via the amplifier 51, thus the speaker 52 starts to generate the musical tone corresponding to the designated melody tone.

After executing the above process of step 202, the processing returns to step 114 of the main program (see FIG. 3) via step 207. Incidentally, if there is no newly depressed melody key, the judgement result of step 111 turns to "NO" so that the processing proceeds to step 114 via steps 112 and 113.

On the other hand, when the depressed melody key is released, the key-release event (i.e., key-off event) is detected so that the judgement result of step 114 turns to "YES". Since the first mode is set now, the judgement result of step 115 turns to "YES" so that the processing proceeds to step 116 wherein the channel which is assigned during the key-depression period is searched based on the event key code indicative of the released key. Then, the flag indicative of the key-release is set in the searched channel. Thus, the microcomputer 71 executes the key-release process concerning the released key. Thereafter, in step 116, the channel data indicative of the searched channel and the flag data indicative of the key-release are supplied to the musical tone signal generating circuit 50.

As a result, the CPU 71 controls the musical tone signal generating circuit 50 such that the tone volume of the musical tone signal is attenuated in the above searched channel designated by the channel data. Thus, the melody tone which is generated from the speaker 52 is gradually attenuated and then its tone-generation is terminated.

Incidentally, if there is no new key-release even in the melody keyboard 20, the judgement result of step 114 turns to "NO" so that the processing proceeds to step 121 via steps 115 to 120.

As described heretofore, in the case where the first mode is set in the present electronic musical instrument, the speaker 52 can sound the melody tone according to the melody performance of the melody keyboard 20 in addition to the chord tone according to the chord performance of the accompaniment keyboard 10.

Figure 7:
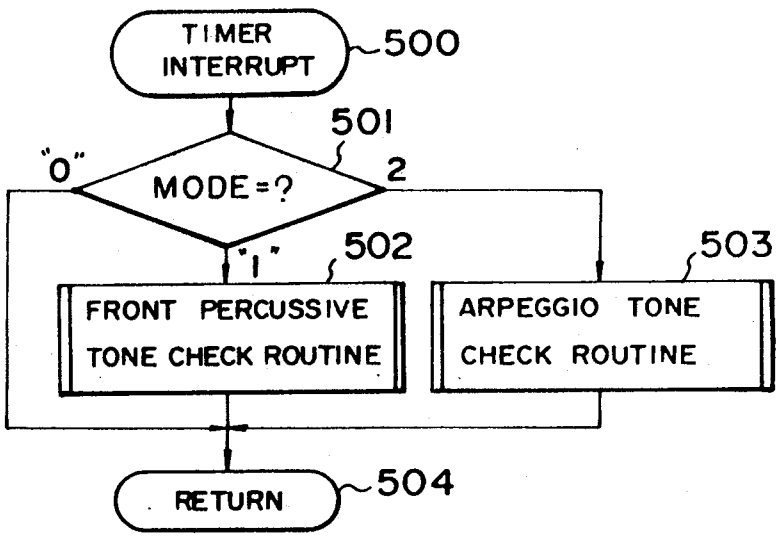

During the execution of the main program, when the timer circuit 60 outputs the timer interrupt signal, the CPU 71 starts to execute the timer interrupt program as shown in FIG. 7. This timer interrupt program is started from step 500, and then the value of mode data MODE is detected in step 501. Since MODE is at "0" in the first mode, the processing proceeds to step 504 from step 501, so that the execution of the timer interrupt program is terminated. In short, in the first mode, this timer interrupt program is not substantially executed.

(2) SECOND MODE

This second mode is set in the processes of steps 105 to 107 of FIG. 3, wherein MODE is at "1".

As similar to the first mode, when any melody key is depressed, the processes of steps 111 and 112 are executed and then the melody key-on routine is to be executed in step 113.

Since MODE is at "1" in the second mode, the processing proceeds to step 203 via step 201 (see FIG. 4), wherein the musical tone signal generating circuit 50 receives control data by which the musical tone signal in No. 0 channel is rapidly attenuated. Thus, this circuit 50 rapidly attenuates the melody tone which is now generating. Then, it is prepared to generate the front percussive ton signal concerning the melody tone. Thereafter, the processing proceeds to step 204 wherein the front percussive tone deciding routine is to be executed.

Figure 5:
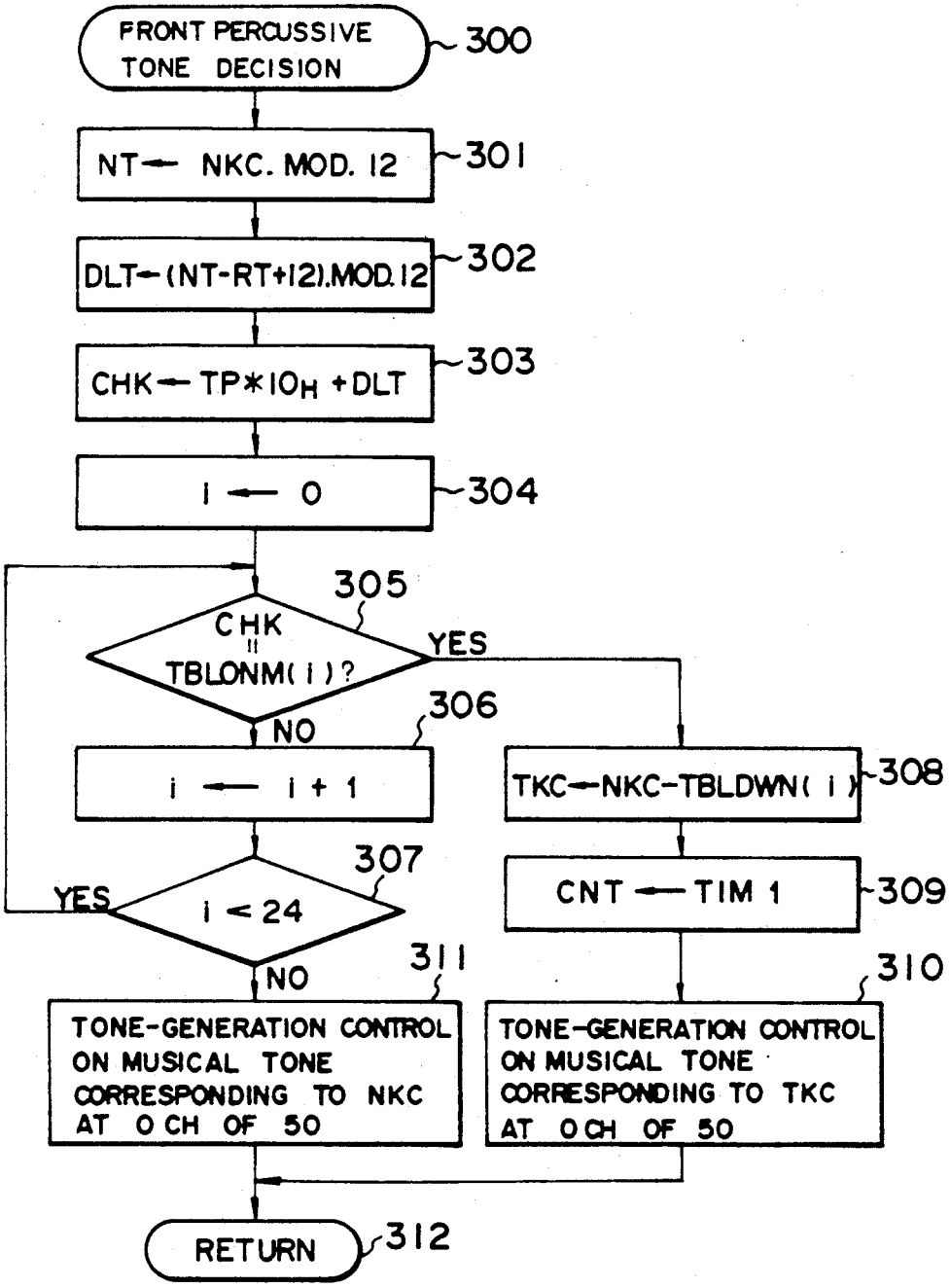

This front percussive tone deciding routine as shown in FIG. 5 is started from step 300, and then note data NT is set and stored by the following logical operation (1).

$$NT = NKC.MOD.12 \quad (1)$$

In (1), the operator ".MOD." indicates the remainder of the division result of "NKC/12". Therefore, such remainder is set as the note data NT. As a result, the note data NT indicates the tone name of any one of twelve scales which corresponds to the key indicated by the new key code NKC.

In next step 302, the interval data DLT is set and stored by the following logical operation (2).

$$DLT = (NT - RT + 12).MOD.12 \quad (2)$$

Thus, the interval data DLT is set to have the value indicative of the interval in the upper direction (i.e., pitch ascending direction) from the tone name of root tone data RT to the tone name of note data NT. In (2), the reason why "12" is added to "NT-RT" is to prevent the negative value from being resulted from the above operation in parentheses.

In step 303, the check data CHK is calculated from the following operation (3).

$$CHK = TP*10_H + DLT \quad (3)$$

In (3), the type data TP is shifted by four bits in binary manner by above "TP*$10_H$". Therefore, the upper four bits of the check data CHK indicate the chord type which is designated by the accompaniment keyboard 10, while the lower four bits thereof indicate the interval between the melody tone and the root of chord tone.

In next step 304, the variable i is initialized to "0". Then, i is added with "1" in step 306, and it is judged whether or not i is lower than "24" in step 307. By the circulating processes of steps 305 to 307, the variable i is incremented by "1" between "0" and "23", wherein the CPU 71 refers to the front percussive tone table 81 in step 305. Every time the variable i is incremented from "0" to "23" so that the address is renewed in the circulating processes of steps 305 to 307, the front percussive tone data TBLONM in the table 81 is compared to the check data CHK. In step 305, it is judged whether or not TBLONM coincides with CHK. As a result, in these circulating processes, the CPU 71 searches the proper melody tone to be added with the front percussive tone by every chord type.

When the CPU 71 finds out TBLONM equal to CHK, the judgement result of step 305 turns to "YES" so that the processing proceeds to step 308 wherein the down data TBLDWN is read from the table 81 based on the address value, i.e., the variable i at which TBLONM coincides with CHK. In addition, the following operation (4) sets the front percussive tone key code TKC indicative of the tone pitch of the front percussive tone.

$$TKC = NKC - TBLDWN(i) \quad (4)$$

In this process of step 308, the suitable down data TBLDWN(i) is decided by every chord type. Based on this down data TBLDWN(i), the suitable front percussive tone key code TKC is decided by every chord type.

In next step 309, the first timer data TIM1 is set as the count data CNT. In step 310, the front percussive tone key code TKC and the channel data indicative of No. 0 channel are supplied to the musical tone signal generating circuit 50. Then, this circuit 50 starts to generate the musical tone having the tone pitch indicated by TKC in its No. 0 channel. Thus, the speaker 52 sounds the musical tone corresponding to the musical tone signal supplied thereto.

Thereafter, the processing proceeds to step 312, wherein the front percussive tone deciding routine is terminated. Therefore, the processing returns to the melody key-on routine (see FIG. 4). Afterwards, in the foregoing step 207 of FIG. 4, the processing returns to the main program shown in FIG. 3.

As similar to the case of first mode, when the timer circuit 60 generates the timer interrupt signal in the second mode, the CPU 71 starts to execute the timer interrupt program (see FIG. 7). Since MODE is at "1" in the second mode, the processing proceeds to step 502 from step 501, wherein the front percussive tone check routine is to be executed.

Figure 8:
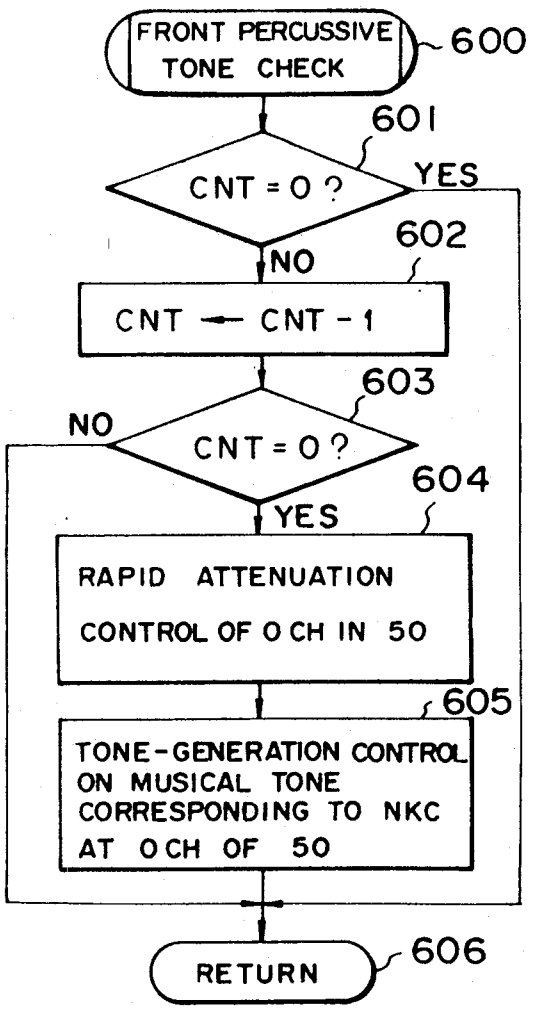

This front percussive tone check routine as shown in FIG. 8 starts from step 600, and then it is judged whether or not the count data CNT is at "0" in step 601. Due to the process of step 309 (see FIG. 5), the first timer data TIM1 is set as CNT so that CNT is not at "0". Therefore, the judgement result of step 601 turns to "NO" so that the processing proceeds to step 602 wherein "1" is subtracted from CNT. Then, in next step 603, it is judged again whether or not CNT is at "0". The judgement result of this step 603 must turn to "NO", so that the execution of the front percussive tone check routine is terminated in step 606. Then, the processing returns to step 504 of the timer interrupt program (see FIG. 7) wherein the execution of this timer interrupt program is terminated. Afterwards, the processing returns to the main program of FIG. 3.

Thereafter, when the timer circuit 60 generates the timer interrupt signal again, the processing proceeds to the execution of the timer interrupt program of FIG. 7, whereby the count data CNT is decremented by "1" in the foregoing steps 600 to 603, 606 of the front percussive tone check routine of FIG. 8. Thus, every time the timer interrupt signal is generated, CNT is decremented by "1". In such decrement of CNT, when the predetermined time (e.g., 30 ms to 100 ms) is passed after the melody tone is generated by depressing the melody key, CNT is decreased to "1". In this case, when the front percussive tone check routine of FIG. 8 is started by the timer interrupt signal, CNT becomes equal to "0" by the subtraction of step 602. Therefore, the judgement result of step 603 turns to "YES" so that the processing proceeds to step 604.

In step 604, the control data is outputted in order to rapidly attenuate the musical tone signal generated at No. 0 channel of the circuit 50. In next step 605, the new key code NKC and the channel data indicative of No. 0 channel are supplied to the circuit 50. Thus, after the musical tone signal generating circuit 50 attenuates the musical tone signal, it starts to generate another musical tone signal having the tone pitch indicated by the new key code NKC. Therefore, the speaker 52 terminates to sound the front percussive tone and then starts to sound the musical tone having the tone pitch designated by the melody keyboard 20. As a result, as shown in FIG. 10A, the melody tone designated by the melody keyboard 20 is added with the front percussive tone corresponding to the chord tone designated by the accompaniment keyboard 10 during the period of 30 ms to 100 ms. Thus, the music is automatically added with the performance effect for the country music.

After executing the above-mentioned process of step 605, the CPU 71 terminates the execution of the front percussive tone check routine in step 606, so that the main program of FIG. 3 is executed again as described before. In this case, eve when the timer interrupt signal is generated so that the execution of the front percussive tone check routine of FIG. 8 is started by the timer interrupt program of FIG. 7, CNT remains at "0" so that the judgement result of step 601 turns to "YES". Hence, without executing the processes of steps 602 to 605, the processing proceeds to step 606. During these processes, CNT still remains at "0".

When one melody key is depressed and another depressed melody key whose melody tone is sounded is released, the melody key-release event is detected so that the judgement result of step 114 in the main program of FIG. 3 turns to "YES". Then, in next step 115, it is judged whether or not MODE is at "0". In the present second mode, MODE is at "1" so that the processing proceeds to step 117 from step 115, wherein it is judged whether or not the event key code indicative of the released melody key is equal to the new key code NKC. In this case, the new key code NKC is set as the key code for the melody tone to be sounded (i.e., the key code indicative of the key which is depressed last). So, in the case where the depressed melody key concerning the melody tone to be sounded is released, the event key code must be equal to the new key code NKC. In such case, the judgement result of step 117 turns to "YES" so that the processing proceeds to step 118 wherein it is judged whether or not MODE is at "1". In this second mode, the judgement result of step 118 is "YES" so that the processing proceeds to step 119. In this step 119, the channel data indicative of No. 0 channel and the key-release data are supplied to the musical tone signal generating circuit 50, wherein No. 0 channel is the channel from which the melody tone is to be sounded.

As a result, the musical tone signal generating circuit 50 attenuates the melody tone signal (which is sounded from No. 0 channel), so that the sounding melody tone is attenuated and finally its tone-generation is terminated.

Meanwhile, when the performer depresses the melody key to which the front percussive tone should not be added, the CPU 71 executes the circulating processes of steps 305 to 307 in FIG. 5, wherein the CPU 71 can not find out the front percussive tone data TBLONM equal to the check data CHK in the table 81 so that the variable i reaches "24". Hence, the judgement result of step 307 turns to "NO". Then, the processing proceeds to step 311 wherein the new key code NKC and the channel data indicative of No. 0 channel are supplied to the musical tone signal generating circuit 50, wherein NKC is set in step 112 of the main program of FIG. 3 and NKC is the key code indicative of the depressed melody key. As a result, this circuit 50 starts to generate the musical tone signal having the tone pitch indicated by the new key code NKC at its No. 0 channel. Thus, the speaker 52 sounds the musical tone having the tone pitch corresponding to the depressed melody key without sounding the front percussive tone.

In the meantime, when the melody key is newly depressed, the melody tone which has been sounding is rapidly attenuated by the process of step 203 in FIG. 4, regardless of whether or not another melody key is depressing. In addition, due to the processes of steps 310 and 311 in FIG. 5, the front percussive tone and melody tone concerning the newly depressed melody key will be certainly sounded. This means that, in the second mode, the tone-generation of the front percussive tone and melody tone is controlled in the last-come last-served manner in which the key depressed last is given the higher priority over another previously depressed key. In such case, when the melody key concerning the melody tone which has been sounding is released, the released key must be differed from the key depressed last. So, the judgement result of step 117 of the main program of FIG. 3 turns to "NO". In other words, it is judged that the event key code is not equal to the new key code NKC. Then, the processing proceeds to step 121 from step 117.

(3) THIRD MODE

As described before, this third mode is set by the processes of steps 108 to 110 of the main program of FIG. 3, wherein MODE is at "2".

As similar to the first and second modes, when any melody key is depressed in the third mode, the CPU 71 executes the melody key-on routine (see FIG. 4) at step 113 in FIG. 3.

Since MODE is at "2" in the third mode, the processing proceeds to step 205 from step 201 in FIG. 4, wherein the control data is supplied to the musical tone signal generating circuit 50 such that the musical tone signals of No. 0 to No. 3 channels are rapidly attenuated. Then, this circuit 50 prepares to generate the arpeggio tones. After completing this process of step 205, the execution of the arpeggio tone deciding routine is made in step 206.

Figure 6A:
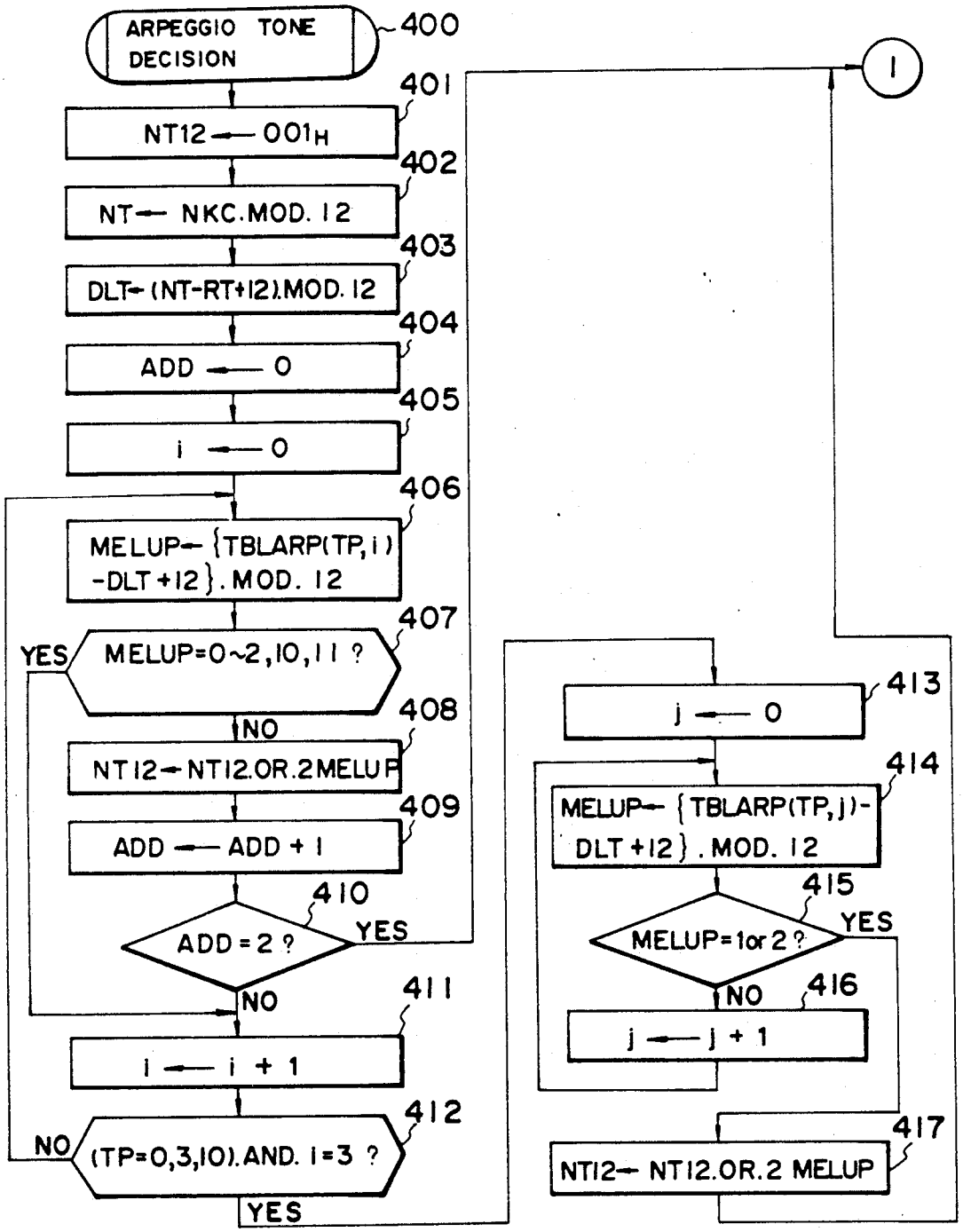
Figure 6B:
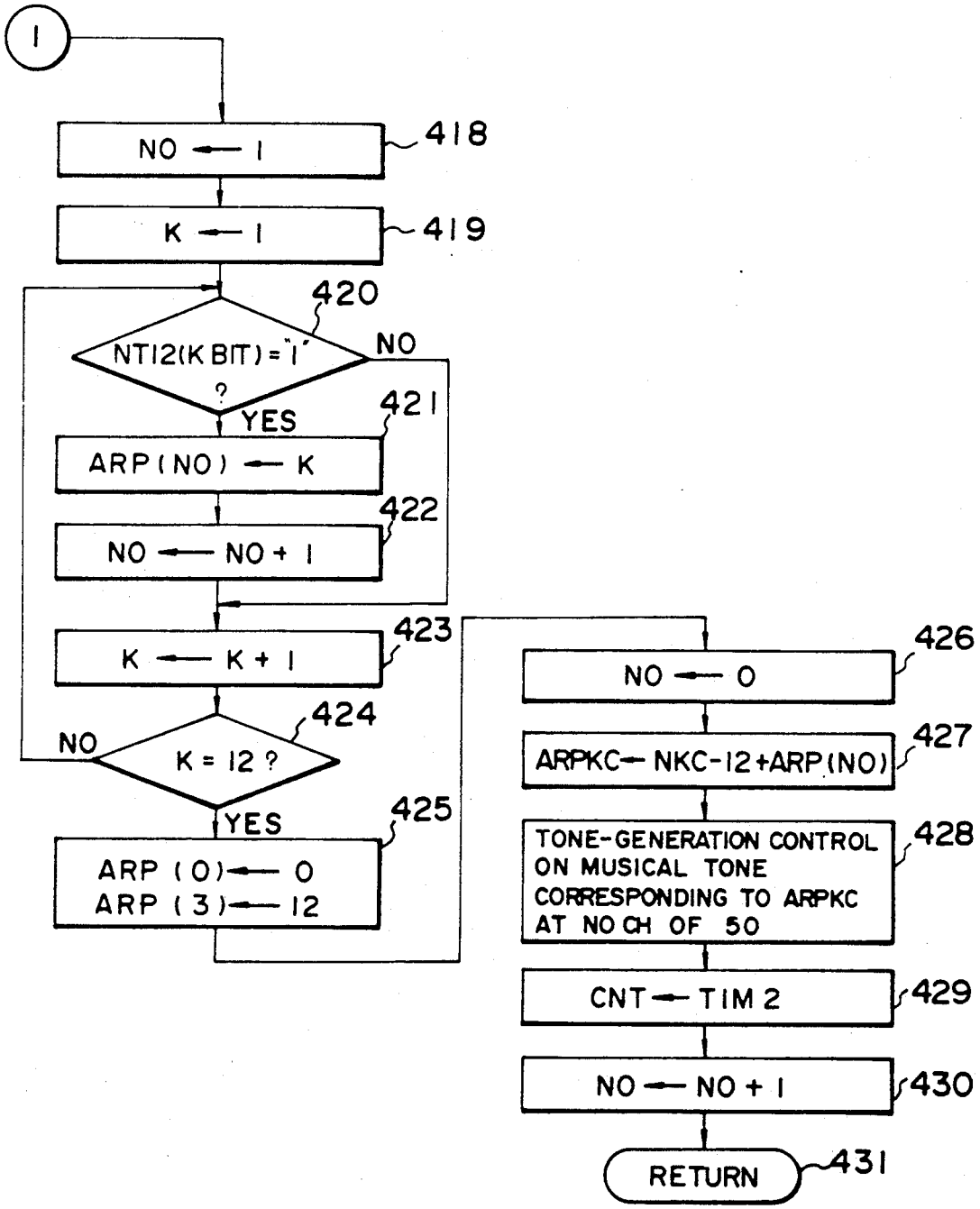

This arpeggio tone deciding routine a shown in FIGS. 6A and 6B is started from step 400 in FIG. 6A, and then the least significant bit (LSB) of the arpeggio note data NT12 is set at "1" by the following operation (5) in step 401.

$$NT12 = 001_{HH} \quad (5)$$

Figure 11:
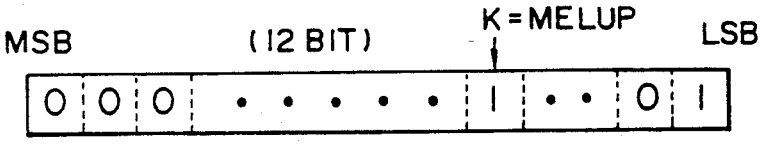
FIG. 11 is a drawing showing a data format of arpeggio note data.

As shown in FIG. 11, this arpeggio note data NT consists of twelve bits each corresponding to each of twelve tone names within one octave. In this data NT, the LSB indicates the key whose tone pitch is octave below that of the depressed key, and the tone pitch becomes higher as the bit number becomes higher. Each bit having the value "1" designates the note whose tone is to be sounded, while each bit having the value "0" designates the note whose note is not sounded. In (5), the suffix "H" indicates "16" which means the hexadecimal value.

Next, processes of steps 402 and 403 in FIG. 6A are similar to those of foregoing steps 301 and 301 in FIG. 3, wherein the note data NT and interval data DLT (see FIG. 12A) are set and stored by executing the following logical operations (6) and (7).

$$NT = NKC.MOD.12 \quad (6)$$

$$DLT = (NT - RT + 12).MOD.12 \quad (7)$$

After step 403, initial value "0" is set to additional tone number data ADD which is used for counting the decided tones to be added to the melody tone as the arpeggio tones in step 404. In step 405, the variable i is initialized to "0". In next step 406, the CPU 71 refers to the arpeggio tone table 82. Then, the CPU 71 reads arpeggio tone data TBLARP(TP,i) from the table 82, wherein this read data is designated by the variable i and the type data TP which is set by the process of step 122 (see FIG. 3) in the main program in accordance with the chord tone to be designated by the accompaniment keyboard 10. Thereafter, the following logical operation (8) is executed based on the data TBLARP(TP,i) and interval data DLT so that melody up data MELUP is calculated.

$$MELUP = [TBLARP(TP,i) - DLT + 12].MOD.12 \quad (8)$$

Figure 12A:
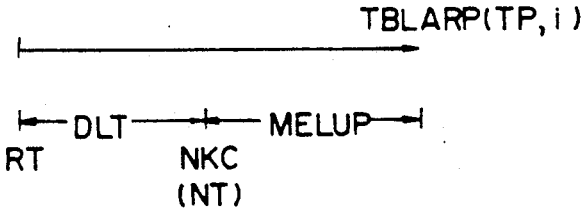
FIGS. 12A and 12B are drawings for explaining intervals used for key-depression tone, chord root tone, arpeggio tone etc.

In (8), as shown in FIG. 12A, the data TBLARP(TP,i) designates the interval between the root of the chord tone indicated by the root tone data RT and the tone name of the depressed melody key in the pitch ascending direction. In addition, the interval data DLT also designates the same interval. Therefore, the melody up data MELUP designates the interval between the tone name of the depressed melody tone and the that of the arpeggio tone data TBLARP(TP,i) in the pitch ascending direction.

Afterwards, in step 407, it is judged the melody up data MELUP equals to any one of the values 0, 1, 2, 10 and 11. This judging process of step 407 prohibits the certain tones from being sounded as the arpeggio tones, wherein these certain tones belong to the range of two tones (i.e., four semitones) departing from the melody tone designated by the melody keyboard 20. When the judgement result of this step 407 is "NO", the processing proceeds to step 408 wherein the arpeggio note data NT12 is renewed by the following logical operation (9).

$$NT12 = NT12.OR.2^{MELUP} \quad (9)$$

In (9), the operator ".OR." means the OR operation to be executed between NT12 and $2^{MELUP}$. Thus, in the arpeggio note data NT12, "1" is set to the bit position which is higher from the LSB by the bits corresponding to the interval designated by the melody up data MELUP wherein this LSB indicates the note which is one octave below the note of depressed melody key.

In next step 409, "1" is added to the additional tone number data ADD. Then, in step 410, it is judged whether or not this data ADD reaches "2". If the judgement result of this step 410 is "NO", the processing proceeds to step 411. In the meantime, in the foregoing step 407, when it is judged that the melody up data MELUP equals to any one of the values 0, 1, 2, 10 and 11, the processes of steps 408 to 410 are omitted and then the processing proceeds to step 411.

In step 411, "1" is added to the variable i. In step 412, it is judged whether or not the type data TP has any one of the values 0, 3, 10 and the variable i reaches "3". In this judging process of step 412, in the case where there are only three constituent tones in the chord which are added as the arpeggio tones (see FIG. 2B) so that the judgement result of step 412 is "YES", two additional tones can not be obtained under the prohibition condition of the foregoing step 407 In this case, this prohibition condition is released and then the additional tones are decided in the following steps 413 to 417.

On the other hand, when the judgement result of step 412 is "NO", the processing returns to step 406 so that the circulating processes of steps 406 to 412 are executed again. Due to these circulating processes, the additional tone as the arpeggio tone to which the higher priority is given is selected first from the arpeggio tone table 82, wherein this additional tone to be selected first corresponds to the smaller variable i. Then, when the two additional tones are decided so that the additional tone number data ADD reaches "2", the judgement result of step 410 turns to "YES" so that the processing proceeds to step 418.

Meanwhile, in the case where the type data TP has any one of the values 0, 3, 10 and the variable i reaches "3" before the additional tone number data ADD reaches "2", the judgement result of step 412 turns to "YES" so that the processing enters into the processes of steps 413 to 417.

In step 413, another variable j is initialized to "0". Then, the process of next step 414 corresponds to the process of foregoing step 406, wherein the melody up data MELUP is calculated by executing the following logical operation (10).

$$MELUP=[TBLARP(TP,j)-DLT+12].MOD.12 \quad (10)$$

In next step 415, it is judged whether or not MELUP equals to any one of the values 1, 2. When the judgement result of this step 415 is "NO", "1" is added to the variable j in step 416. Then, the processing returns to step 414. Thereafter, until the condition of step 415 is satisfied, the CPU 71 repeatedly executes the circulating processes of steps 414 to 416. When the judgement result of step 415 turns to "YES", the CPU 71 executes the process of step 417 corresponding to the process of foregoing step 408, wherein the arpeggio note data NT12 is renewed by executing the following logical operation (11).

$$NT12=NT12.OR.2^{MELUP} \quad (11).$$

Due to the above processes of steps 406 to 417, two additional tones must be decided in any cases. Then, "1" is set at the bit position corresponding to the tone name of the additional tone in the arpeggio note data NT12.

After executing the process of step 417 or if the judgement result of step 410 turns to "YES", the processing proceeds to step 418 in FIG. 6B, wherein the arpeggio tone order data NO indicative of the sounding order of the arpeggio tones (i.e. the pitch ascending order of the arpeggio tones) is set at "1". In step 419, a variable K indicative of the bit position of the arpeggio note data NT is set at "1", wherein this bit position can takes values 0 to 11. In next step 420, it is judged whether or not "1" is set to the bit K of the arpeggio note data NT which is designated by the variable K. If the judgement result of step 420 is "NO", "1" is added to the variable K in step 423, and then it is judged whether or not the variable K reaches "12" in step 424. Therefore, until the variable K reaches "12", i.e., until the check is completely made from the LSB to the MSB in the arpeggio note data NT, the processes of steps 420, 423 and 424 are repeatedly executed.

Figure 12B:
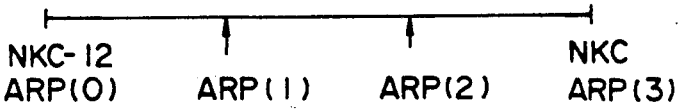

Meanwhile, when it is judged that "1" is set to the bit K of the arpeggio note data NT12 in step 420, the variable K is set to the arpeggio tone data ARP(NO) which is designated by the arpeggio tone order data NO in step 421. Then, "1" is added to the arpeggio tone order data NO in step 422. Thereafter, the processing proceeds to step 423. During the execution of the circulating processes of steps 420 to 424, when the variable K reaches "12" so that the judgement result of step 424 turns to "YES", the processing proceeds to step 425 wherein the values "0" and "12" are respectively set to the arpeggio tone data ARP(0) and ARP(3). Due to the processes of steps 421 and 425, the arpeggio tone data ARP(0), ARP(1), ARP(2) and ARP(3) respectively indicate the following first, second, third and fourth tones, wherein these first to fourth tones are disposed in the pitch ascending order. More specifically, fourth tone has the tone pitch designated by the melody keyboard 20, and the first tone has the tone pitch which is one octave below the designated tone pitch. In addition, the tone pitch of the second tone is lower than that of the third tone, and both of the second and third tones are extracted from the arpeggio tone table 82. As shown in FIG. 12B, ARP(1), ARP(2), ARP(3) take the respective values corresponding to the intervals of the second, third, fourth tones based on the first tone.

Afterwards, the arpeggio tone order data NO is initialized to "0" in step 426, and then an arpeggio tone key code ARPKC is calculated by executing the following operation (12).

$$ARPKC=NKC-12+ARP(NO) \quad (12)$$

In (12), the arpeggio tone order data NO is at "0", and "0" is set to the arpeggio tone data ARP(0) designated by this data NO in the foregoing step 425. Therefore, the arpeggio tone key code ARPKC indicates the tone pitch designated by the new key code NK. In other words, ARPKC indicates the tone pitch which is one octave below the tone pitch of the melody tone designated by the melody keyboard 20.

In step 428, the arpeggio tone key code ARPKC and the channel data (indicative of No. 0 channel designated by the arpeggio tone order data NO) are supplied to the musical tone signal generating circuit 50. As a result, this circuit 50 starts to generate the musical tone signal having the tone pitch indicated by the arpeggio tone key code APRKC in No. 0 channel. Therefore, the speaker 52 starts to sound the musical tone corresponding to the key whose tone pitch is one octave below that of the depressed melody key In next step 429, the count data CNT is set as the second timer data TIM2, wherein CNT is used for calculating the tone-generation delay time for each arpeggio tone. In step 430, "1" is added to the arpeggio tone order data NO so that NO is renewed at "1". Thereafter, the execution of the arpeggio tone deciding routine is terminated in step 431, so that the processing returns to the melody key-on routine (see FIG. 4). Then, by way of the foregoing step 207 of this routine, the processing returns to the main program of FIG. 3.

In this state, when the timer circuit 60 outputs the timer interrupt signal, the execution of the timer interrupt program is started from step 500 in FIG. 7, as similar to the cases of first and second modes. Since the mode data MODE is at "2" in the third mode, the processing proceeds to step 503 via step 501, wherein the arpeggio tone check routine is to be executed.

Figure 9:
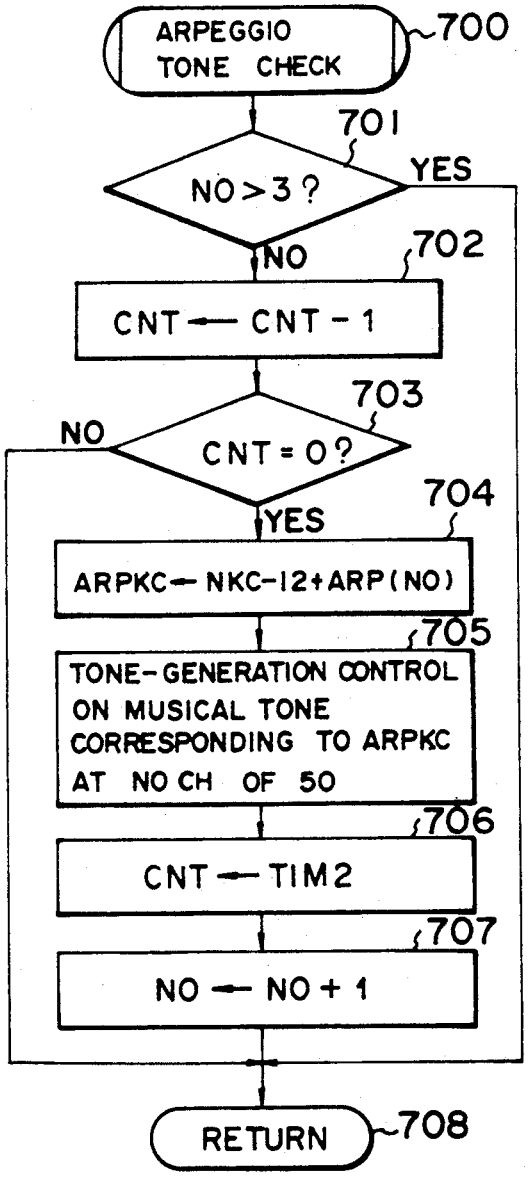

This arpeggio tone check routine as shown in FIG. 9 is started from step 700, and then it is judged whether or not the arpeggio tone order data NO is larger than "3" in step 701. At this time, this data NO is at "1" so that the judgement result of step 701 is "NO", whereby the processing proceeds to step 702 wherein "1" is subtracted from the count data CNT. In next step 703, it is judged whether or not CNT is at "0". As described before, the second timer data TIM2 is set as the count data CNT by the process of step 429 in FIG. 6B. Therefore, CNT is not at "0" so that the judgement result of step 703 is "NO". Then, the processing proceeds to step 708 wherein the execution of the arpeggio ton check routine is terminated. Thereafter, the processing returns to step 504 of the timer interrupt program (see FIG. 7), from which the processing further returns to the main program of FIG. 3.

Afterwards, when the timer circuit 60 outputs the timer interrupt signal again, the processes of foregoing steps 700 to 703, 708 are executed so that the count data CNT is decremented by "1". As described above, every time the timer interrupt signal is outputted, CNT is decremented by "1". Therefore, when the predetermined time (e.g., 30 ms to 100 ms) is passed after the first arpeggio tone is generated in accordance with the key-depression of the melody keyboard 20, the count data CNT is decreased to "1". In this state where CNT is at "1", when the timer interrupt signal is outputted, the subtraction process of step 702 makes CNT at "0" in the arpeggio tone check routine in FIG. 9. Then, the judgement result of step 703 turns to "YES", so that the processing proceeds to step 704.

In step 704 corresponding to the foregoing step 427 in FIG. 6B, the new arpeggio tone key code ARPKC is calculated by executing the following operation (13).

$$ARPKC = NKC - 12 + ARP(NO) \quad (13)$$

In (13), the arpeggio tone order data NO is at "1", and the arpeggio tone data ARP(1) designated by this data NO is extracted from the arpeggio tone table 82 by the process of foregoing step 421 in FIG. 6B. In short, this data ARP(1) is set as the additional tone of the lower tone pitch. Therefore, the arpeggio tone key code ARPKC corresponds to the tone name of the above additional tone whose tone pitch is set between the tone pitch designated by the melody keyboard 20 and its one octave lower tone pitch.

After the arpeggio tone key code ARPKC is newly set in the above step 704, this arpeggio tone key code ARPKC and the channel data indicative of No. 1 channel designated by the arpeggio tone order data NO are supplied to the musical tone signal generating circuit 50. As a result, this circuit 50 starts to generate the musical tone signal having the tone pitch indicated by ARPKC at its No. 1 channel. Thus, the speaker 52 starts to sound the second arpeggio tone, which is delayed by 30 ms to 100 ms from the first arpeggio tone.

In next step 706, the second timer data TIM2 is set as the count data CNT again. In step 707, "1" is added to the arpeggio tone order data NO so that the value of data NO is renewed to "2". Thereafter, the execution of the arpeggio tone check routine is terminated in step 708, and the processing returns to the timer interrupt program in FIG. 7. Then, the processing further returns to the main program from step 504 in FIG. 7.

During the execution of the main program, when the timer circuit 60 generates the timer interrupt signal again, the processing enters into the arpeggio tone check routine a described heretofore. In such case, the process of step 702 (see FIG. 9) also decrements the count data CNT by "1". When the predetermined time of 30 ms to 100 ms is passed after the second arpeggio tone is generated, CNT decreases to "0" so that the judgement result of step 703 turns to "YES". Then, the processes of steps 704 to 707 are executed again. However, it is noted that the arpeggio tone order data NO is at "2" and the arpeggio tone data ARP(2) is extracted from the table 82 by the process of foregoing step 421 in FIG. 6B. Therefore, this data ARP(2) is set as the additional tone of the higher tone pitch. Thus, the arpeggio tone key code ARPKC corresponds to the tone name which is identical to that of the above additional tone, wherein the tone pitch of this tone name is set between the tone pitch designated by the melody keyboard 20 and its one octave lower tone pitch. In step 705, the data indicative of "2" which equals to the arpeggio tone order data NO is supplied to the musical tone signal generating circuit 50 a the channel data. Therefore, this circuit 50 starts to generate the musical tone signal having the tone pitch indicated by ARPKC. Thus, the speaker 52 starts to sound the third arpeggio tone, which is delayed by the predetermined time of 30 ms to 100 ms from the second arpeggio tone. In this case, due to the processes of steps 706 and 707, the second timer data TIM2 is set as CNT. Then, the arpeggio tone order data NO is renewed to "3".

In the above-mentioned state, every time the timer circuit 60 generates the timer interrupt signal, the arpeggio tone check routine is executed in the execution of the timer interrupt program, so that the tone-generation of the arpeggio tone is controlled. More specifically, when the predetermined time of 30 ms to 100 ms is passed after the third arpeggio tone is generated, the judgement result of step 703 turns to "YES" so that the processing proceeds to step 704 wherein the new arpeggio tone key code ARPKC is calculated by executing the following operation (14).

$$ARPKC = NKC - 12 + ARP(NO) \quad (14)$$

In next step 705, the arpeggio tone key code ARPKC and the channel data indicative of the channel designated by the arpeggio tone order data NO(="3") are supplied to the musical tone signal generating circuit 50, so that the fourth arpeggio tone designated by ARPKC is started to be generated from its No. 3 channel. In this case, the data NO is set at "3", and the data ARP(NO) is set at "12" by the process of step 425 (see FIG. 6B). Therefore, the arpeggio key code AKC indicates the new key code NKC, i.e., the tone pitch designated by the melody keyboard 20. As a result, the fourth arpeggio tone must correspond to the tone pitch designated by the melody keyboard 20.

After executing the process of step 705, the second timer data TIM2 is set to the count data CNT again in step 706, and "1" is added to the data NO so that NO is set at "4" in step 707. Thereafter, the execution of the arpeggio tone check routine is terminated in step 708.

Figure 10B:
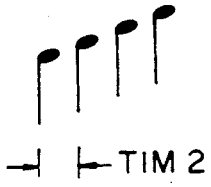

Thus, each of the first to fourth arpeggio tones is sounded by every predetermined time of 30 ms to 100 ms in the pitch ascending order (see FIG. 10B). For this reason, the specific performance effect of the piano cocktail music is automatically added to the performed music in the third mode.

In such state, even if the timer interrupt signal from the timer circuit 60 activates the execution of the arpeggio tone check routine, the data NO is set at "4" so that the processing directly proceeds to step 708 from step 701 in FIG. 9. Therefore, the processes of steps 702 to 707 are omitted, so that the tone-generation control is not made on the arpeggio tone.

When the depressed melody key is released during the tone-generation of the first to fourth arpeggio tones concerning the depressed melody key, as similar to the case of second mode, the processing passes through the foregoing steps 114, 115, 117 and then proceeds to step 118 wherein it is judged whether or not MODE is at "1" in FIG. 3. In this case, MODE is set at "2" so that judgement result of step 118 is "NO". Then, the processing proceeds to step 120 wherein the first to fourth arpeggio tones to be generated from No. 0 to No. 3 channels are controlled to be attenuated.

Even in the third mode, when the new melody key is depressed, the process of step 205 in FIG. 4 controls the generating melody tone to be rapidly attenuated, and the new first to fourth arpeggio tones concerning the newly depressed melody key are started to be generated under execution of the arpeggio tone deciding routine (see FIGS. 6A and 6B) and the arpeggio tone check routine (see FIG. 9), regardless of whether or not another melody key is depressing. This means that the tone-generation of the arpeggio tone is controlled in the last-come last-served manner even in the third mode. Incidentally, when the performer releases the key concerning the arpeggio tone which has been sounded, this released key must be different from the last depressed key. Therefore, it is judged that the event key code is not equal to the new key code NKC so that the judgement result of step 117 in FIG. 3 turns to "NO". Then, the processing proceeds to step 121.

[C] Modified Examples of Embodiment

Next, description will be given with respect to the modified examples of the present embodiment.

(1) In the present embodiment described heretofore, the melody tone to be given the front percussive tone and the interval between the melody tone and the front percussive tone are limited to those based on the front percussive tone table 81. However, the present invention is not limited to such present embodiment. More specifically, in the case where the number of the melody tones to be given the front percussive tones is quite small in the performed music, it is possible to decide more melody tones to be given the front percussive tones as compared to those of the present embodiment. On the other hand, in the case where the number of the melody tones to be given the front percussive tones is quite large, it is possible to decide less melody tones to be given the front percussive tones as compared to those of the present embodiment. In addition, it is possible to select desirable one of the conditions for giving the front percussive tones. Further, the interval values as set in the present embodiment can be arbitrarily changed. Or, it is possible to select desirable one of the interval values. Particularly, it is possible to decide the tone pitch of the front percussive tone which is higher than that of the melody tone.

(2) In the present embodiment, all of the additional tones belong to the one octave range below the tone pitch of the designated melody tone, and the arpeggio tones are sequentially sounded in the pitch ascending order. Instead, it is possible to set the additional tones to belong to the one octave range above the tone pitch of the designated melody tone. In addition, it is possible to sequentially sound the arpeggio tones in the pitch descending order. Further, it is possible to change the number of additional tones and its tone areas as compared to those of the present embodiment.

Moreover, as the additional tone included in the arpeggio tones, it is possible to select desirable one of the 5-degree tone, duet tone etc., each having the predetermined interval with respect to the tone pitch of the melody tone. In addition, it is possible to select desirable one of the predetermined kinds of the additional tones.

(3) In the present embodiment, the interval between the melody tone and front percussive tone is decided by referring to the front percussive tone table 81 in the second mode, while the arpeggio tones are decided by referring to the arpeggio tone table 82 in the third mode. Instead of these tables, it is possible to decide the interval, the arpeggio tones etc. in accordance with the operations which are preset in the programs.

(4) In the present embodiment, the first and second timer data TIM1, TIM2 indicative of the tone-generation timing of the front percussive tone and the tone-generation delay time for the arpeggio tones are fixed. Instead, it is possible to arbitrarily vary these data TIM1, TIM2. In addition, it is possible to differ each time interval between two of first to fourth arpeggio tones to be sequentially sounded.

(5) In the present embodiment, the chord tone is generated at the key-depression timing of the accompaniment keyboard 10. Instead, it is possible to additionally provide the automatic accompaniment function to the electronic musical instrument according to the present invention, wherein the tone-generation timing of the chord tone is automatically decided by this function. Thus, the automatic performance of the chord tone can be made. Further, it is possible to additionally provide the auto-rhythm function to the present electronic musical instrument, wherein the percussive musical tones of cymbal, bass drum etc. are automatically sounded by this function.

Above is the whole description of the preferred embodiment and its modified examples. This invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. An electronic musical instrument comprising:

(a) melody designating means for designating a melody tone to be generated;

(b) chord designating means for designating a chord tone to be generated;

(c) musical tone signal generating means for generating a musical tone signal;

(d) means for determining whether or not additional tones are to be generated, wherein a first additional tone has the same tone name as any one of constituent tones within said chord tone and a tone pitch between that of said first melody tone and a second additional tone which has a pitch difference of one or more octaves with respect to said melody tone; and (e) control means for generating a musical tone generation control signal, by which said musical tone signal generating means is controlled such that musical tone signals corresponding to said first additional tone, said second additional tone and said melody tone are sequentially generated by a predetermined time difference in a predetermined pitch order wherein said melody tone is generated last.

2. An electronic musical instrument according to claim 1 further comprising prohibiting means for controlling said means to prohibit generation of a first additional tone having a tone pitch which is relatively close to that of said melody tone or said second additional tone.

3. An electronic musical instrument as set out in claim 1, wherein aid predetermined pitch order is a pitch ascending order.

4. An electronic musical instrument as set out in claim 1, wherein said predetermined pitch order is a pitch descending order.

5. An electronic musical instrument comprising:

(a) melody designating means for designating a first melody tone to be generated;

(b) chord designating means for designating a chord tone to be generated;

(c) musical tone signal generating means for generating a musical tone signal;

(d) first selecting means for selecting plural additional tones to be additionally generated, wherein each of said additional tones has the same tone name as any one of constituent tones within said chord tone and a tone pitch between that of said first melody tone and an added melody tone which has a pitch different of one or more octaves with respect to said first melody tone;

(e) excluding means for excluding certain additional tones from said plural additional tones, wherein each of said certain additional tones to be excluded has a tone pitch which is relatively close to that of said first melody tone or said added melody tone;

(f) second selecting means for selecting a certain number of additional tones from said additional tones which are selected by said first selecting means but not excluded by said excluding means, wherein said certain number of additional tones are decided by a priority order corresponding to said chord tone; and (g) control means for generating a musical tone generation control signal, by which said musical tone signal generating means is controlled such that musical tone signals corresponding to said first melody tone, said added melody tone and said certain number of additional tones are sequentially generated by a predetermined time difference in a pitch descending order wherein said first melody tone is generated last.

6. An electronic musical instrument, comprising:

(a) melody keyboard means which is performed by a performer so that a desirable tone pitch of a melody tone to be sounded is designated;

(b) accompaniment keyboard means which is performed by a performer so that a desirable chord tone to be sounded is designated;

(c) operator control means capable of designating at least a tone color and a tone volume of a musical tone to be sounded;

(d) memory means for storing data concerning additional tones to be additionally sounded with said melody tone, said memory means comprising:

(i) a first table for pre-storing data indicative of front percussive tones as said additional tones, desirable one of said front percussive tones corresponding to said melody tone to be presently designated being automatically and additionally sounded prior to said melody tone; and (ii) a second table for pre-storing other data indicative of arpeggio tones as said additional tones, said arpeggio tones corresponding to each chord tone so that desirable arpeggio tones are automatically selected in accordance with a chord type of said chord tone designated by said accompaniment keyboard means; said desirable arpeggio tones being sounded with a predetermined time difference in a sequence ending with said melody tone, (e) musical tone signal generating means for generating a musical tone signal; and (f) control means for controlling said musical tone signal generating means, said control means automatically and arbitrarily selecting one or more additional tones from said memory means, whereby, under control of said control means and said operator control means, said musical tone signal generating means generates musical tone signals based on said chord tone, said melody tone and said additional tone, so that desirable musical tones are to be sounded based on said musical tones.

7. An electronic musical instrument, according to claim 6, wherein said operator control means provides mode selecting means by which a desirable one of a first mode, a second mode and a third mode is to be selected, wherein said musical tone signals are generated based on said melody tone and said chord tone in said first mode, and said musical tone signals are generated based on said melody tone, said chord tone and said additional tone in said second and third modes, wherein said front percussive tones are used as said additional tone in said second mode and said arpeggio tones are used as said additional tone in said third mode.

* * * * *